US011359516B2

(12) United States Patent
Ahlbom

(10) Patent No.: US 11,359,516 B2
(45) Date of Patent: Jun. 14, 2022

(54) SYSTEM AND METHOD FOR ELIMINATING THE PRESENCE OF DROPLETS IN A HEAT EXCHANGER

(71) Applicant: ClimeOn AB, Kista (SE)

(72) Inventor: Esko Ahlbom, Uppsala (SE)

(73) Assignee: ClimeOn AB, Kista (SE)

( * ) Notice: Subject to any disclaimer, the term of this patent is extended or adjusted under 35 U.S.C. 154(b) by 259 days.

(21) Appl. No.: 16/622,884

(22) PCT Filed: Jun. 13, 2018

(86) PCT No.: PCT/SE2018/050612
§ 371 (c)(1),
(2) Date: Dec. 13, 2019

(87) PCT Pub. No.: WO2018/231132
PCT Pub. Date: Dec. 20, 2018

(65) Prior Publication Data

US 2020/0208542 A1 Jul. 2, 2020

(30) Foreign Application Priority Data

Jun. 16, 2017 (SE) ..... 1750765-8

(51) Int. Cl.
*F01K 13/02* (2006.01)
*F01K 25/10* (2006.01)
(Continued)

(52) U.S. Cl.
CPC ..... *F01K 13/02* (2013.01); *F01K 13/003* (2013.01); *F01K 25/106* (2013.01); *F22G 5/16* (2013.01);
(Continued)

(58) Field of Classification Search
CPC ..... F01K 13/02
See application file for complete search history.

(56) References Cited

U.S. PATENT DOCUMENTS 4,031,404 A * 6/1977 Martz ..... F01K 23/108 290/40 R
2010/0307155 A1* 12/2010 Kasuya ..... F01K 23/065 60/666
(Continued)

FOREIGN PATENT DOCUMENTS

DE 202012001522 U1 * 3/2012 ..... F01K 23/10
EP 2674697 A1 12/2013
(Continued)

OTHER PUBLICATIONS

PCT/SE2018/050612—Written Opinion and International Search Report dated Sep. 25, 2018, 6 pages.
(Continued)

*Primary Examiner* — Laert Dounis
(74) *Attorney, Agent, or Firm* — Haynes Beffel & Wolfeld LLP; Andrew Dunlap

(57) ABSTRACT

The present invention relates to a system for eliminating the presence of droplets in a first medium of a heat exchanger. The heat exchanger has an inlet port and an outlet port for the first medium as well as an inlet port and an outlet port for a second medium. The system comprises (a) a device for regulating the flow of the first medium into the heat exchanger, (b) a first temperature sensor array for measuring the temperature of the first medium exiting the heat exchanger, and (c) a controller for regulating flow of the first medium into the heat exchanger. The system further comprises a second temperature sensor array for measuring the temperature of the second medium entering the heat exchanger. The controller regulates the flow of the first medium into the heat exchanger based on data received from the first temperature sensor array and second temperature sensor array.

21 Claims, 5 Drawing Sheets

(51) Int. Cl.

| | |
|---|---|
| ***F01K 13/00*** | (2006.01) |
| ***F22G 5/16*** | (2006.01) |
| ***F01K 3/18*** | (2006.01) |
| ***F01K 7/16*** | (2006.01) |
| ***F28F 27/02*** | (2006.01) |

(52) U.S. Cl.
CPC ..... *F01K 3/185* (2013.01); *F01K 7/16* (2013.01); *F28F 27/02* (2013.01)

(56) References Cited

U.S. PATENT DOCUMENTS

| | | | | |
|---|---|---|---|---|
| 2014/0224469 | A1* | 8/2014 | Mirmobin | F24H 9/2007 165/244 |
| 2015/0377535 | A1* | 12/2015 | Kono | F28F 27/003 62/186 |
| 2017/0167810 | A1 | 6/2017 | Nyander et al. | |
| 2018/0033941 | A1* | 2/2018 | Matsuda | B01J 19/24 |
| 2019/0024538 | A1* | 1/2019 | Hikichi | F01K 7/30 |

FOREIGN PATENT DOCUMENTS

| | | | |
|---|---|---|---|
| EP | 2985563 | B1 | 8/2017 |
| SE | 1750765 | A1 | 12/2018 |
| SE | 541066 | C2 | 3/2019 |
| WO | 2012128715 | A1 | 9/2012 |
| WO | 2014042580 | A1 | 3/2014 |
| WO | 2015034418 | A1 | 3/2015 |
| WO | 2015112075 | A1 | 7/2015 |
| WO | 2015152796 | A1 | 10/2015 |
| WO | 2016076779 | A1 | 5/2016 |
| WO | 2017065683 | A1 | 4/2017 |

OTHER PUBLICATIONS

PCT/SE2018/050612 International Preliminary Reporton Patentability, dated Dec. 17, 2019, 5 pages.
JP 2019-568389 First Office Action, dated Jul. 6, 2021, 9 pages.
JP 2019-568389 Voluntary Amendments, dated Jun. 11, 2021, 9 pages.
JP 2019-568389 Voluntary Amendments, dated Oct. 5, 2021, 9 pages.
JP 2019-568389 Response to First Office Action dated Jul. 6, 2021, filed Oct. 5, 2021, 7 pages.
JP 2019-568389 Notice of Allowance, dated Nov. 2, 2021, 5 pages.
EP 18733963.5 Certificate of patent, dated Aug. 10, 2021, 1 page.

* cited by examiner

SYSTEM AND METHOD FOR ELIMINATING THE PRESENCE OF DROPLETS IN A HEAT EXCHANGER

CROSS-REFERENCE

This application is the U.S. National Stage of International Application No. PCT/SE2018/050612, filed 13 Jun. 2018, which claims priority to Swedish Patent Application No. SE 1750765-8, filed 16 Jun. 2017.

TECHNICAL FIELD

The present invention relates to a system and method for eliminating the presence of droplets in a heat exchanger, i.e. the present invention relates to a system and method comprising a droplets sensor.

BACKGROUND OF INVENTION

Turbines are essential elements used in power plants such as power plants run by thermodynamic power cycles such as the Rankine cycle, Kalina cycle, Carbon Carrier cycle and/or Carnot cycle. In power plants, a liquid is heated until it is converted in to dry gas which then enters a turbine to do work. The liquid is typically heated in a heat exchanger and the produced dry gas exits from the outlet port of the medium to be heated.

A problem which often arises in power plants is that the gas in not wholly dry, i.e. there are liquid droplets in the gas. The momentum of fast moving liquid droplets exiting from a heat exchanger damages turbine blades and shortens the life of the turbine. Turbines are typically the most expensive parts of power plants; hence, there is a need of eliminating the cost of repairing or replacing turbines with damaged turbine blades. A similar problem occurs with compressors which are coupled to heat exchangers, i.e. water droplets damage the compressor. Consequently, there is also a need of eliminating the cost of repairing or replacing compressors.

EP2674697 relates to a plate heat exchanger comprising a sensor arrangement for detecting the presence of liquid content in the evaporated fluid. The sensor arrangement comprises temperature (Tm) and pressure (Pm) sensors and is therefore dependent on the measurement of pressure. Furthermore, the sensor arrangement is placed in a system in which the heat exchanger is used as an evaporator. Hence, the sensor arrangement appears not to be adapted for use in a heat exchanger which is used as a boiler. Moreover, the system in EP2674697 comprises a compressor, i.e. the evaporated liquid is led to a compressor. Hence, it appears as if the sensor arrangement is not adapted to be used in a system comprising a turbine for power generation. Additionally, in the system described in EP2674697, the temperature of the second medium (i.e. the medium which transfers heat to the first medium which is to be evaporated) is not measured which results in less accurate and/or precise detection of droplets in the outlet port of the first medium.

Moreover, in some prior art systems, there is a device for separating droplets from the gas which is led to the turbine. Such a droplet separator is positioned between the outlet of the first medium (i.e. working medium) and the turbine. However, a droplet separator takes up space in the system, and moreover, is an additional cost which makes the system more expensive. Thus, there is a need for a system which is both space and cost effective.

Consequently, in view of the above, there is a need for a system and method for eliminating the presence of droplets in a heat exchanger which is not dependent on the measurement of pressure. Moreover, there is a need for a system and method for eliminating the presence of droplets in a heat exchanger which is adapted to be used in together with a turbine. Furthermore, there is a need for a system and method for eliminating the presence of droplets in a heat exchanger which is adapted to be used with said heat exchanger being a boiler. Additionally, there is a need for more accurate and/or precise detection of droplets in the outlet port of the first medium.

OBJECT OF THE INVENTION

The first object of the invention is to provide a system and method for eliminating the presence of droplets in a heat exchanger.

A further object of the invention is to provide a system and method for eliminating the presence of droplets in a heat exchanger which is not dependent on the measurement of pressure.

A further object of the invention is to provide a system and method for eliminating the presence of droplets in a heat exchanger which is adapted to be used in together with a turbine.

A further object of the invention is to provide a system and method for eliminating the presence of droplets in a heat exchanger which is configured as a boiler.

A further object of the invention is to provide a system and method for eliminating the presence of droplets in a heat exchanger which is configured as an evaporator.

A further object of the invention is to provide a system and method for eliminating the presence of droplets in a heat exchanger which is accurate and/or precise in the detection of droplets.

A further object of the invention is to reduce cost of repair and replacement of turbines.

A further object of the invention is to reduce cost of repair and replacement of compressors.

A further object of the invention is to provide a cost-effective system and method for eliminating the presence of droplets in a heat exchanger.

SUMMARY OF INVENTION

The objects of the invention are attained by the first and second aspects of the invention. More importantly, the complex set of problems and disadvantages associated with prior art techniques are solved by said first and second aspects of the invention.

In a first aspect of the invention, there is provided a system for eliminating the presence of droplets in a first medium arranged to be heated by a second medium in a heat exchanger, wherein the heat exchanger has an (i) inlet port and an outlet port for the first medium, and (ii) an inlet port and an outlet port for the second medium, wherein the second medium transfers heat to the first medium, said system comprising a) a first temperature sensor array being configured for measuring the temperature of the first medium exiting the heat exchanger, the first temperature sensor array comprising at least one temperature sensor, b) a controller connected at least to a device for regulating flow of the first medium into the heat exchanger and the first temperature sensor array, characterized in that the system further comprises a second temperature sensor array being connected to the controller and configured for measuring the temperature of the second medium entering the heat exchanger, the second temperature sensor array comprising at least one temperature sensor, wherein the controller is configured to control the device for regulating flow of the first medium into the heat exchanger based on data received from the first temperature sensor array and the second temperature sensor array, wherein the controller is configured to control the device for regulating flow of the first medium to reduce the flow of the first medium into the heat exchanger if the measured temperature difference between the second temperature sensor array and the first temperature sensor array is higher than a setpoint temperature, wherein the temperature difference being higher than the setpoint temperature is indicative of the presence of droplets passing the outlet port of a first medium, and wherein the controller is configured to control the device for regulating flow of the first medium to reduce the flow of the first medium into the heat exchanger until the measured temperature difference between the second temperature sensor array and the first temperature sensor array is lower than or equal to the setpoint temperature.

In one embodiment, the first temperature sensor array comprises two temperature sensors being a first temperature sensor A and a first temperature sensor B, and wherein the controller is configured to control the device for regulating flow of the first medium to reduce the flow of the first medium into the heat exchanger if the measured temperature difference between the second temperature sensor array and either one of first temperature sensor A and a first temperature sensor B is higher than the setpoint temperature, wherein the controller is configured to control the device for regulating flow of the first medium to reduce the flow of the first medium into the heat exchanger until the measured temperature difference between the second temperature sensor array and either one of the first temperature sensor A and the first temperature sensor B is lower than or equal to the setpoint temperature.

In one embodiment, the second temperature sensor array comprises two temperature sensors being second temperature sensor C and a second temperature sensor D.

In one embodiment, said first medium is arranged to be boiled or evaporated and overheated to a selected overheating temperature by said second medium in said heat exchanger. In one embodiment said heat exchanger is therefore configured as a boiler or as an evaporator, for example selected from the group consisting of plate heat exchanger, plate-and-shell heat exchanger, plate-fin heat exchanger and shell-and-tube heat exchanger.

In one embodiment, the first temperature sensor array is arranged in a heat exchanger outlet port (3) of the first medium at a position (i) before the heat exchanger outlet port of the first medium, (ii) at the heat exchanger outlet port of the first medium, and/or (iii) after the heat exchanger outlet port of the first medium preferably in a tube (i.e. pipe) leading the first medium away from the heat exchanger.

In one embodiment, the first temperature sensor A and a first temperature sensor B are positioned: (i) at an approximately equal distance from the heat exchanger outlet port of the first medium, or (ii) an unequal distance from the heat exchanger outlet port of the first medium.

In one embodiment, the first temperature sensor A and a first temperature sensor B are positioned at a circumferential position 0-360° (i) before the heat exchanger outlet port of the first medium, (ii) at the heat exchanger outlet port of the first medium, and/or (iii) after the heat exchanger outlet port of the first medium, preferably the first temperature sensor A and a first temperature sensor B are positioned (i) at a top position, and/or (ii) at the bottom position, and/or (iii) at an angle of +/−45° within said circumferential position and/or (iv) anywhere within said outlet port.

In one embodiment, the setpoint temperature depends on the process conditions in the system, preferably said process conditions are at least one of the following: type of medium used as first medium, type of medium used as second medium, pressure(s) and flows in the system, ambient temperature, selected overheating temperature, differential temperature of the second medium between inlet port and outlet port of the heat exchanger.

In one embodiment, the setpoint temperature is preferably 10° C., more preferably 5° C., even more preferably 3° C., most preferably 2° C.

In one embodiment, the controller is a Proportional Integral Derivative (PID) controller or a PID controller in a Programmable Logic Controller (PLC).

In one embodiment, the at least one of the temperature sensors of the first and second temperature sensor arrays is a resistance temperature detector.

In one embodiment, at least one of the temperature sensors of the first and second temperature sensor arrays is a platinum resistance thermometer.

In one embodiment, at least one of the temperature sensors of the first and second temperature sensor arrays is a platinum resistance thermometer having a nominal resistance of 10-1000 ohms at 0° C., preferably a platinum resistance thermometer having a nominal resistance of 100 ohms at 0° C.

In one embodiment, the at least one of the temperature sensors of the first and second temperature sensor arrays is at least one temperature measuring wire.

In one embodiment, the at least one of the temperature sensors of the first and second temperature sensor arrays comprises two temperature measuring wires which may or may not intersect with each other.

In one embodiment, the at least one of the temperature sensors of the first and second temperature sensor arrays comprises two temperature measuring wires which are either configured in parallel, perpendicular or at any angle with respect to each other.

In one embodiment, the at least one of the temperature sensors of the first and second temperature sensor arrays comprises four temperature measuring wires wherein two of the wires are configured in parallel with respect to each other while the other two wires are configured in parallel with each other as well as configured perpendicular with respect to the other two wires.

In a second aspect of the invention, there is provided a method for eliminating the presence of droplets in a first medium arranged to be heated by a second medium in a heat exchanger, said method comprises the steps:

a. guiding a second medium and a first medium through a heat exchanger to transferring heat from the second medium to the first medium, wherein the heat exchanger comprises:
   i. an inlet port and an outlet port for the first medium, wherein the first medium is the medium to which heat is transferred, and
   ii. an inlet port and an outlet port for a second medium which transfers heat to the first medium,
b. regulating the flow of the first medium into the heat exchanger, by using a device for regulating the flow, c. measuring the temperature of the first medium exiting the heat exchanger, by using a first temperature sensor array, the first temperature sensor array comprising at least one temperature sensor, The method is characterized by the steps:

d. measuring the temperature of the second medium entering the heat exchanger, by using a second temperature sensor array, the second temperature sensor array comprising at least one temperature sensor, e. controlling the device for regulating flow of the first medium into the heat exchanger based on data received from the first temperature sensor array and second temperature sensor array, by using a controller connected at least to (i) the device for regulating the flow of the first medium into the heat exchanger, (ii) first temperature sensor array, and (iii) second temperature sensor array, f. comparing data received from the first temperature sensor array and second temperature sensor array, g. reducing the flow of the first medium into the heat exchanger if the measured temperature difference between the second temperature sensor array and the first temperature sensor array is higher than a setpoint temperature, wherein the temperature difference being higher than the setpoint temperature is indicative of the presence of droplets passing the heat exchanger outlet port of the first medium, and wherein the controller is configured to control the device for regulating the flow to reduce the flow of the first medium into the heat exchanger until the measured temperature difference between the second temperature sensor array and the first temperature sensor array is lower than or equal to the setpoint temperature.

In one embodiment, the first temperature sensor array comprises two temperature sensors being a first temperature sensor A and a first temperature sensor B, and wherein the controller is configured to control the device for regulating the flow and to reduce of the first medium into the heat exchanger if the measured temperature difference between the second temperature sensor array and either one of first temperature sensor A and a first temperature sensor B is higher than the setpoint temperature, wherein the controller is configured to control the device for regulating the flow to reduce the flow of the first medium into the heat exchanger until the measured temperature difference between the second temperature sensor array and either one of the first temperature sensor A and the first temperature sensor B is lower than or equal to the setpoint temperature.

In one embodiment, the method comprises the step of measuring the second temperature by second temperature sensor array comprising two temperature sensors being second temperature sensor C and a second temperature sensor D.

In one embodiment the step of guiding first and second medium through a heat exchanger to transfer heat from a second medium to the first medium in said heat exchanger is configured to boil or evaporate the first medium and to overheat the first medium to a temperature above a theoretical boiling temperature by a heat transfer from said second medium.

In one embodiment, the method comprises the step of arranging the first temperature sensor array at a position (i) before the heat exchanger outlet port of the first medium, (ii) at the heat exchanger outlet port of the first medium, and/or (iii) after the heat exchanger outlet port of the first medium preferably in a tube leading the first medium away from the heat exchanger.

In one embodiment, comprises the step of arranging the first temperature sensor A and a first temperature sensor B at a position: (i) at an approximately equal distance from the outlet port of the first medium, or (ii) an unequal distance from the outlet port of the first medium.

In one embodiment, the method comprising the step of arranging the first temperature sensor A and a first temperature sensor B at a circumferential position 0-360° (i) before the outlet port of the first medium, (ii) at the outlet port of the first medium, and/or (iii) after the outlet port of the first medium, preferably the first temperature sensor A and a first temperature sensor B are positioned (i) at a top position, and/or (ii) at the bottom position and/or (iii) at an angle of +/−45° within said circumferential position and/or (iv) at any angle within said circumferential position.

In one embodiment, the second temperature sensor array is arranged at a position (i) before the inlet port of the second medium, (ii) at the inlet port of the second medium, and/or (iii) after the inlet port of the second medium.

In one embodiment, the second temperature sensor array, or sensors thereof, is/are positioned: (i) at an approximately equal distance from the inlet port of the second medium, and/or (ii) an unequal distance from the inlet port of the second medium.

In one embodiment, the second temperature array is positioned at a circumferential position 0-360° (i) before the inlet port of the second medium, (ii) at the inlet port of the second medium, and/or (iii) after the inlet port of the second medium, preferably the second temperature is positioned (i) at a top position, and/or (ii) at the bottom position.)

In one embodiment, the method comprises the step of setting the value of the setpoint temperature, wherein the value of the setpoint temperature is set depending on the process conditions in the system, preferably said process conditions process conditions are at least one of the following: type of medium used as first medium, type of medium used as second medium, pressure(s) and flows in the system, ambient temperature, selected overheating temperature $\Delta T_{overheat}$, differential temperature of the second medium between inlet port 6 and outlet port 7 of the heat exchanger.

In one embodiment, the setpoint temperature is preferably 10° C., more preferably 5° C., even more preferably 3° C., most preferably 2° C.

In one embodiment, the controller is arranged to receive data related to the resistance in said sensor, i.e. the first and second temperature sensor arrays is a resistance temperature detector or a temperature measuring wire, for example a platinum resistance thermometer.

In one embodiment, at least one of the temperature sensors of the first and second temperature sensor arrays is a platinum resistance thermometer having a nominal resistance of 50-1000 ohms at 0° C., preferably a platinum resistance thermometer having a nominal resistance of 100 ohms at 0° C.

Another aspect of the invention is the use of the system or method according to the above in a power plant, preferably said power plant employs a thermodynamic cycle selected from the group consisting of Rankine cycle, Kalina cycle, Carbon Carrier cycle and Carnot cycle, more preferably said power plant is a heat power generator, wherein said power plant comprises a circulating first medium, a heat exchanger in which said first medium is arranged to be heated by a second medium and wherein said heat exchanger is configured to boil or evaporate said first medium generating a gas, a turbine coupled to a power-generating device configured to generate electric power while expanding the gas, a condenser arrangement configured to condense the gas which has passed through the power-generating device, and a device for regulating flow of the condensed first medium into the heat exchanger.

DESCRIPTION

The present invention relates to a system and a method for eliminating the presence of droplets in a first medium of a heat exchanger, i.e. the present invention relates to a droplets sensor. The heat exchanger may be configured as a boiler or an evaporator and is preferably selected from a plate heat exchanger, plate-and-shell heat exchanger, plate-fin heat exchanger, shell-and-tube heat exchangers, or variants thereof.

Figure 1:
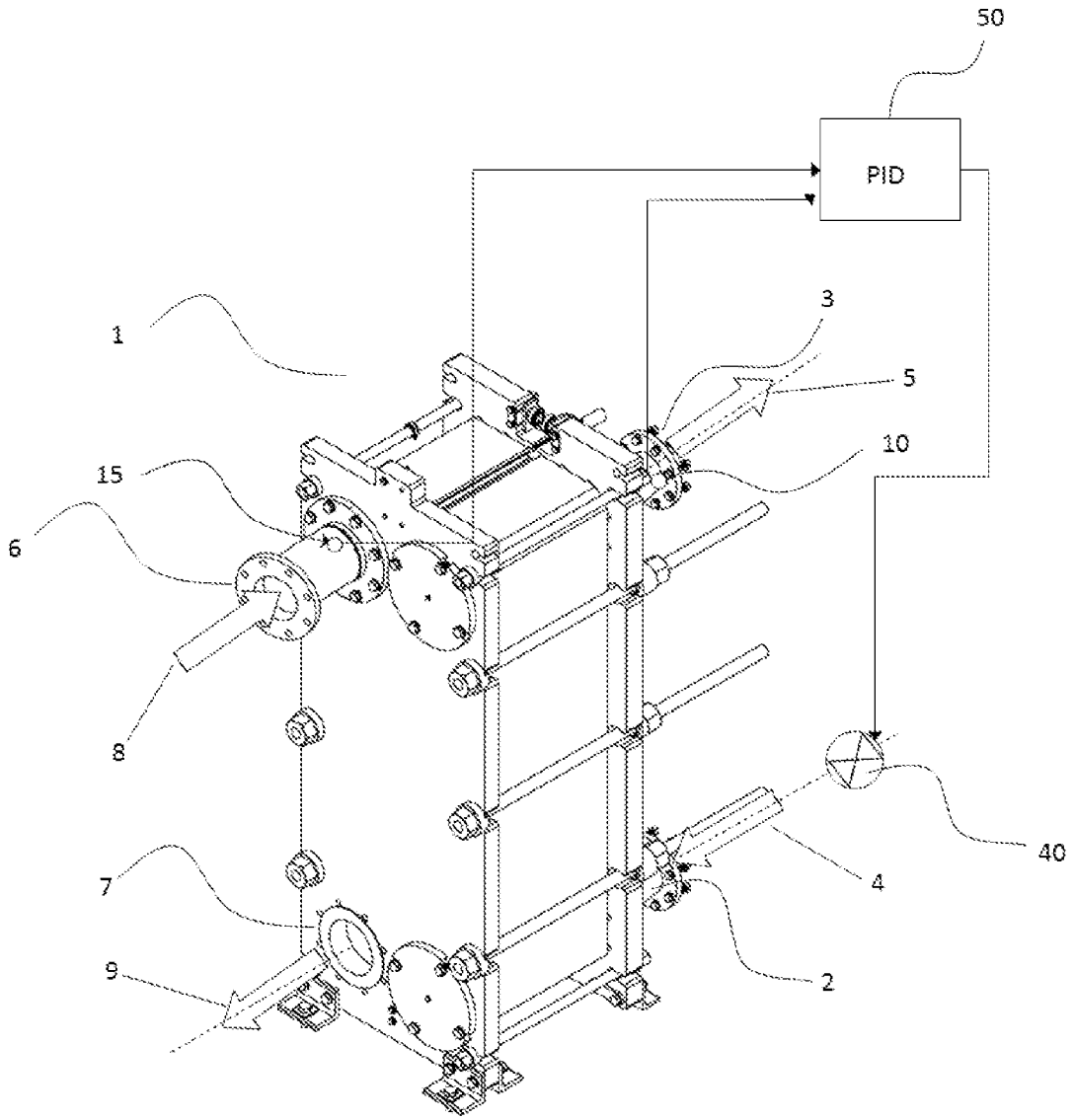
FIG. 1 describes a heat exchanger to be associated with the system and method for eliminating the presence of droplets in a heat exchanger according to the present invention.
Figure 2A:
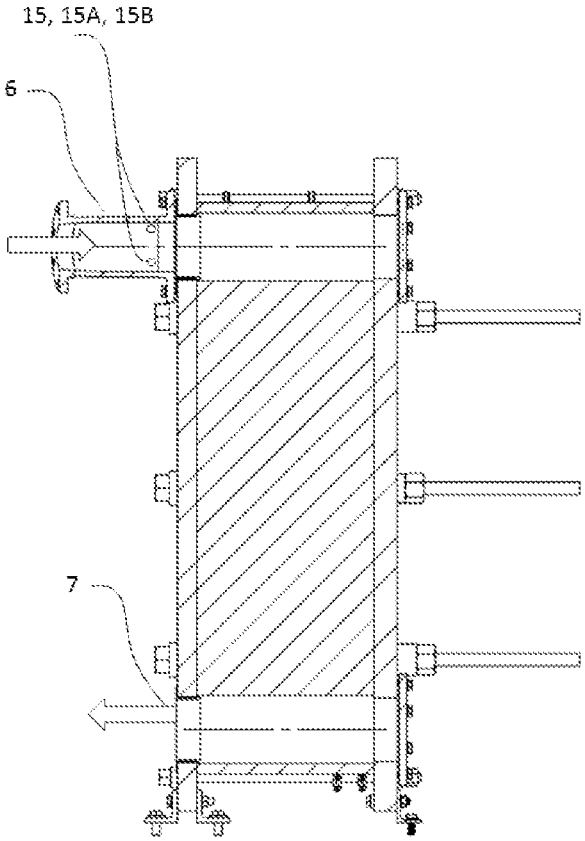
FIGS. 2*a* and 2*b* illustrate side views of a heat exchanger according to FIG. 1. The inlet port 2 and an outlet port 3 for the first medium have been omitted in FIG. 2*a*.
Figure 2B:
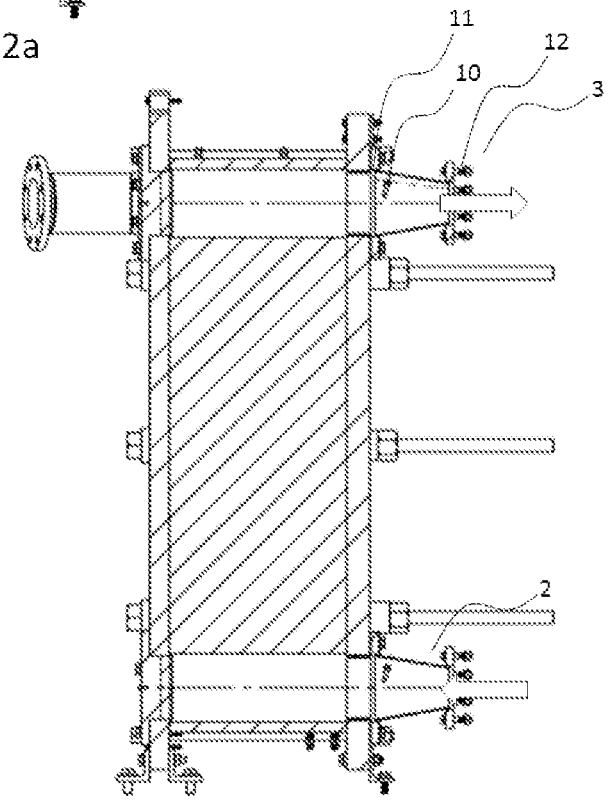

As illustrated in FIGS. 1 and 2, a heat exchanger 1 which the system and method of the present invention is used in has an inlet port 2 and an outlet port 3 for the first medium, as well as an inlet port 6 and an outlet port 7 for the second medium. The arrows 4 and 5 in FIG. 1 show the directions of the first medium entering and exiting the heat exchanger, while the arrows 8 and 9 show the directions of the second medium entering and exiting the heat exchanger. The first medium is in the present invention referred to as the medium to be heated while the second medium is referred to as the medium which transfers heat to the first medium. The first medium may also be referred as the working medium.

The first medium and the second medium are selected from types of mediums or solutions comprising water, alcohols (such as methanol, ethanol, isopropanol and/or butanol), ketones (such as acetone and/or methyl ethyl ketone), amines, paraffins (such as pentane and hexane) and/or ammonia. However, the first medium and the second medium are preferably not the same solvent. Moreover, the boiling point of the first medium is preferably lower than the boiling point of the second medium.

The system and method further comprises at least one device 40, 41 which is configured for regulating the flow of the first medium into the heat exchanger 1 through the first medium inlet port 2. The device may be a valve 41, pump 40 and/or an injector or a combination of devices. Thus, when the controller 50 gives a signal to the device 40, 41 for regulating the flow the device is either; (i) reducing or opening the first medium inlet port area 2, (ii) reducing or increasing the rotation speed of the pump or injector, or (iii) both (i) and (ii).

The system and method further comprises a first temperature sensor array 10 and a second temperature sensor array 15. The first temperature sensor 10 array measures the temperature of the first medium exiting the heat exchanger 1 through first medium outlet port 3, while the second temperature sensor measures the temperature of the second medium entering the heat exchanger 1 through the second medium inlet port 6. The first and second temperature sensor arrays 10, 15 may each comprise one or more temperature sensors 10A, 10B; 15A, 15B, see FIGS. 3*a*-3*e* and 2*a*-2*e*, respectively. The temperature sensors 10A, 10B; 15A, 15B of the first and second temperature sensor arrays 10, 15 may for example be a resistance temperature detector such as a platinum resistance thermometer, e.g. platinum resistance thermometer having a nominal resistance of 10-1000 ohms at 0° C.

Figure 4A:
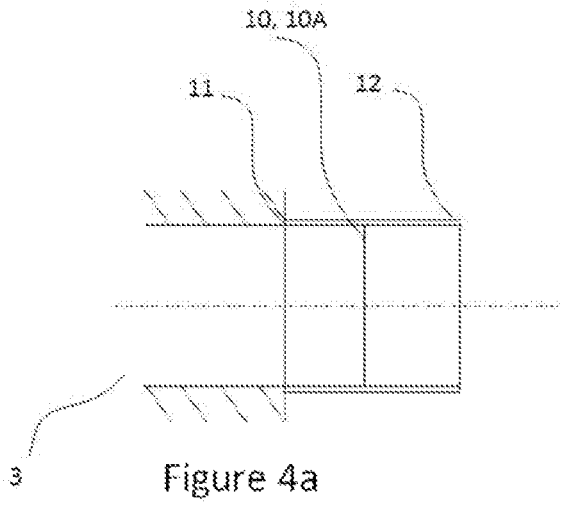
FIGS. 4*a* and 4*b* are cut views of the outlet port of the first medium of a heat exchanger and illustrates different possible positions of the temperature measuring wire(s).
Figure 4C:
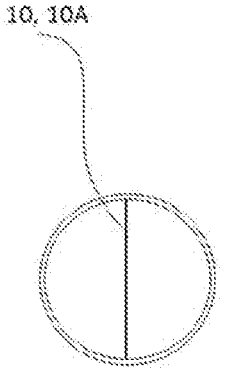
FIGS. 4*c*, 4*d*, 4*e* and 4*f* are views of the outlet port of the first medium looking into the outlet port via the opening of said port and illustrate different possible configurations of the temperature measuring wires.
Figure 4B:
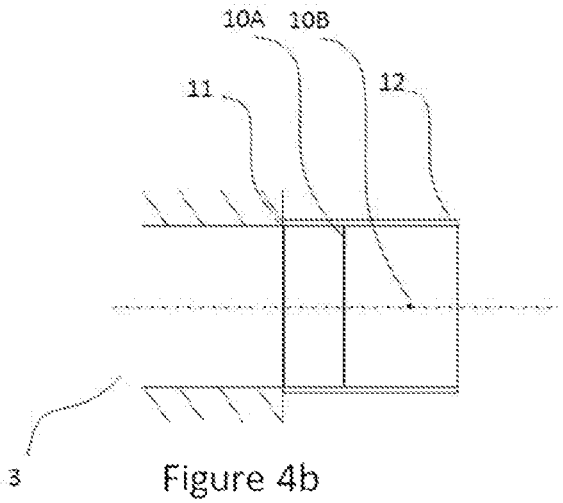
Figure 4E:
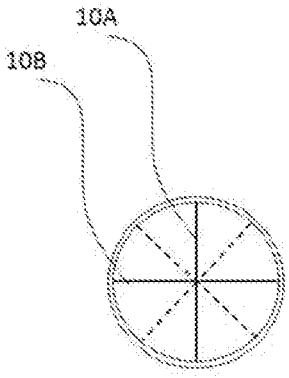
Figure 4D:
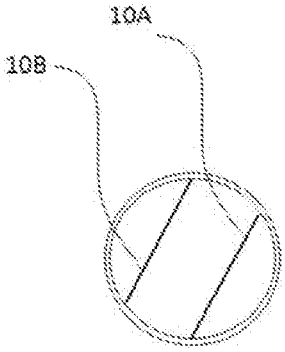
Figure 4F:
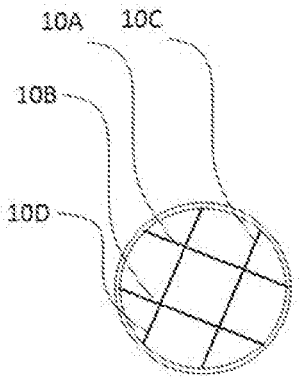

However, usage of other type of temperature sensors is also applicable. Hence, in alternative examples of the present invention, the temperature sensors of the first and second temperature sensor arrays may be one or more temperature measuring wires as illustrated in FIG. 4*c*-4*d*. In one such embodiment, there is a single temperature measuring wire 10A as shown in FIG. 4*c*. There may also be two temperature measuring wires 10A and 10B present arranged at a distance from each other which may or may not intersect with each other. In two such embodiments comprising two temperature measuring wires, there are two temperature measuring wires, 10A and 10B, and they are either (i) configured in parallel with respect to each other (FIG. 4*d*), or (ii) configured perpendicular with respect to each other (FIG. 4*e*). In the embodiment which comprises two wires being perpendicular to each other, the wires may be configured at any circumferential position 0-360° in the first medium outlet port 3. This is illustrated in FIG. 4*e* in which the perpendicular wires are configured in two different circumferential positions in the first medium outlet port 3, wherein in one configuration the wires are shown as dashed lines while in the other configuration the wires are shown as non-dashed lines. In a further embodiment illustrated in FIG. 4*f*, there may be at least four wires 10A, 10B, 10C and 10D wherein two of the wires, 10A and 10B, are configured in parallel with respect to each other, while the other two wires, 10C and 10D, are configured in parallel with each other as well as configured perpendicular or at any other angle with respect to the other two wires 10A and 10 B.

The system and method further comprises a controller 50, e.g. PID controller, connected to the device 40, 41 for regulating flow of the first medium into the heat exchanger 1, the first temperature sensor array 10 as well as the second temperature sensor array 15. The controller 50 controls the device 40, 41 for regulating flow of the first medium into the heat exchanger based on data received from the first temperature sensor array 10 and second temperature sensor array 15.

The controller 50 gives a signal to the device 40, 41 for regulating the flow of first medium to reduce the flow of the first medium into the heat exchanger 1 if the measured temperature difference ΔT between the temperature T2 measured by the second temperature sensor array 15 and the temperature T1 measured by the first temperature sensor array 10 is higher than a setpoint temperature $T_{set}$.

$$\Delta T = T2 - T1 \Delta T > T\text{set}$$

The temperature difference being higher than the setpoint temperature $T_{set}$ indicates the presence of droplets in the first medium.

The controller 50 gives a signal to the device 40, 41 to reduce the flow of the first medium into the heat exchanger 1 through the first medium inlet port 2 until the measured temperature difference between the temperature T2 measured by the second temperature sensor array 15 and the temperature T1 measured by the first temperature sensor array 10 is lower than or equal to the set point temperature $T_{set}$. The setpoint temperature $T_{set}$ depends on the type of medium or solvents used as first medium and second medium and the differential temperature of the second medium between inlet port 6 and outlet port 7. The setpoint temperature $T_{set}$ may be 10° C., preferably 5° C., more preferably 3° C., most preferably 2° C.

The present invention works with overheated gas where the gas temperature is controlled to be a predefined number of degrees Celsius, $\Delta T_{overheat}$, higher than the theoretical boiling point for the first medium (i.e. working medium) at the actual pressure P of the gas outlet (i.e. outlet port 3 of the first medium) of the heat exchanger. Preferably, the well-known Antoine equation is used for determination of the theoretical boiling point. The number of degrees Celsius defined as overheating temperature, $\Delta T_{overheat}$, is set depending in what type of larger system or process, the system for eliminating droplets is adapted to be used.

An overheating of the first medium is possible by transferring heat from the second medium to the first medium by guiding the second medium and the first medium through the heat exchanger 1. Preferably all heat enthalpy of the second medium is transferred to the first medium, i.e. the temperature T1 of the evaporated gaseous first medium is near the temperature T2 of the incoming heat transferring second medium. Thus, there is a need to optimize the process and controlling the flow of first medium through the heat exchanger 1 based on the temperature difference between the temperature T2 of the incoming heat transferring second medium and the temperature T1 of the overheated and evaporated gaseous first medium at ideal evaporation comprising no droplets, this difference is the above-mentioned set point temperature $T_{set}$. The value of the setpoint temperature $T_{set}$ is set depending on the process conditions in said system. Preferably said process conditions are at least one of the following: type of medium used as first medium, type of medium used as second medium, pressure(s) and flows in the system, ambient temperature, selected overheating temperature $\Delta T_{overheat}$, differential temperature of the second medium between inlet port 6 and outlet port 7 of the heat exchanger.

When the gas is overheated, liquid and droplets in the first medium of the heat exchanger has a lower temperature than the gas in the first medium. Thus, when a droplet touches the first temperature sensor array 10, the droplet will cool down the first temperature sensor array 10 immediately. Thus, if the measured temperature difference between the temperature T2 measured by the second temperature sensor array and the temperature T1 measured by the first temperature sensor array is higher than the setpoint temperature $T_{set}$, there are droplets in the working medium and the controller 50 is set to regulate the first medium flow (i.e. working media flow) into the heat exchanger by controlling the device 40, 41 for regulating the flow of the first medium.

Hence, the system and method of the present invention can optimize the heat exchanger to boil as much of the first medium as possible without getting droplets out of the heat exchanger port (i.e. outlet port of the first medium) with a controller such as a simple PID regulator or PID regulator in a PLC or other control system. This is the cheapest way to optimize the usage of a heat exchanger (such as a plate heat exchanger) as boiler without a separator connected to the heat exchanger.

Figure 3A:
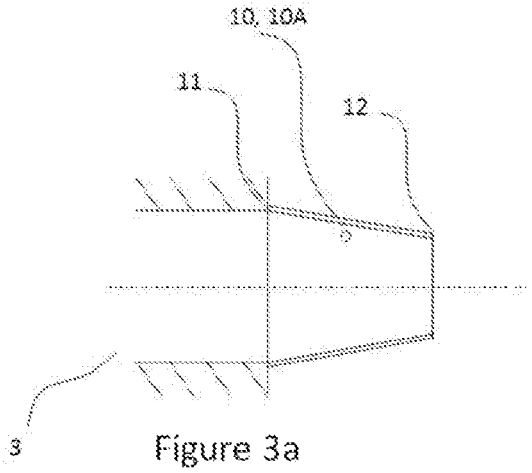
FIGS. 3*a*, 3*b*, 3*c*, 3*d* and 3*e* are cut views of the outlet port of the first medium of a heat exchanger, according to FIG. 1 and illustrates different possible positions of the first temperature sensor array.

FIG. 3*a-e* are cut views of the outlet port 3 of the first medium of a heat exchanger, according to FIG. 1 and illustrates different possible positions of the first temperature sensor array, however other positions are of course also possible. Different positions of the first sensor array 10 or first temperature sensor 10A, 10B may further increase the accuracy of the measurements. The temperature sensors 10A, 10B may for example be arranged at a circumferential position 0-360° within the preferably circular heat exchanger outlet port 3 of the first medium. The temperature measuring units of said first sensor array 10 or first temperature sensors 10A, 10B are preferably arranged at a distance from the walls of the outlet port 3. The sensors will then measure a more accurate temperature, since the temperature of the surroundings will not have an impact on the measured temperature. Although it has been illustrated that the outlet port 3 has a conical shape n FIG. 3*a-e*, the outlet port 3 may have another shapes such as cylindrical shape. In FIG. 3*a*, the first temperature sensor array 10 only comprises one temperature sensor 10A and is positioned at the top position, i.e. at 0°. The top position may also be referred to as the position furthest away in a direction opposite the gravitational field vector.

Figure 3B:
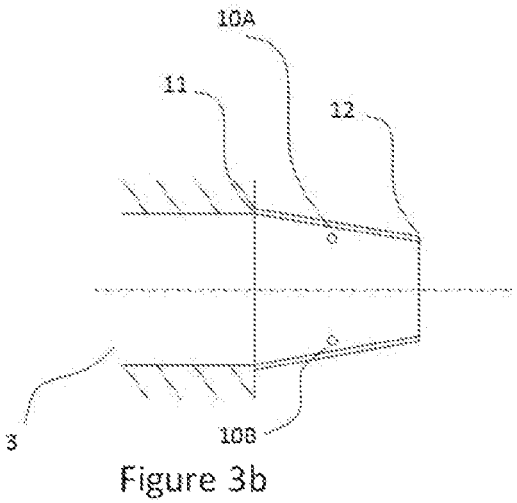

In FIG. 3*b*, the first temperature sensor array comprises two temperature sensors being a first temperature sensor A 10A and a first temperature sensor B 10B and these sensors are placed opposite of each other at the top and bottom positions at a circumferential position 0 and 180°. It is of course also possible to place the first temperature sensor A 10A and the first temperature sensor B 10B at an angle of +/−45° within said circumferential position and/or at any angle within said circumferential position. The angle is chosen depending on the flow through the outlet port 3 of the first medium, thus where the droplets are gathered due to potential turbulence.

Figure 3C:
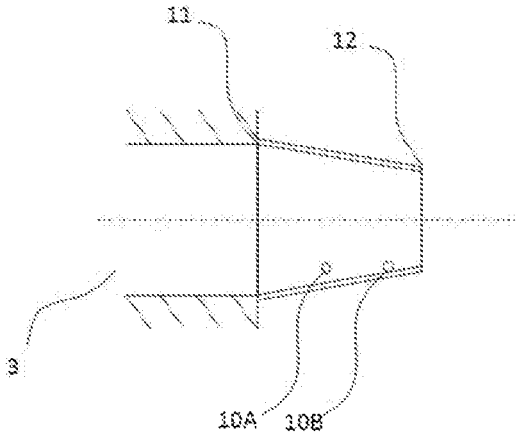

FIG. 3*c* shows an outlet 3 with a first temperature sensor array comprising two temperature sensors being a first temperature sensor A 10A and a first temperature sensor B 10B and wherein these sensors are placed at the bottom position.

Figure 3D:
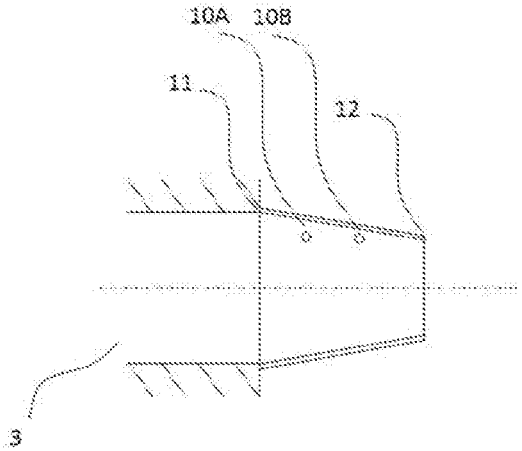

FIG. 3*d* also shows an outlet 3 with a first temperature sensor array comprising two temperature sensors being a first temperature sensor A 10A and a first temperature sensor B 10B, however, the sensors are placed at the top position.

Figure 3E:
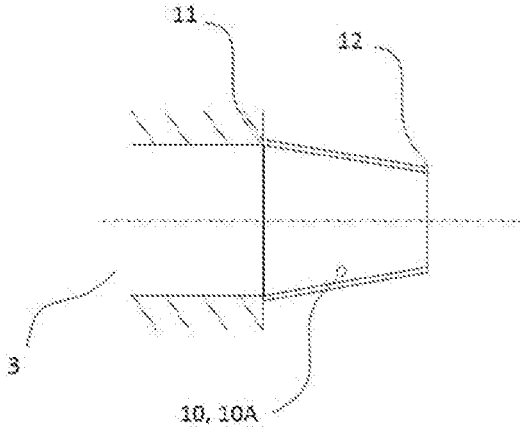

In FIG. 3*e*, the first temperature sensor array only comprises one temperature sensor 10 and is positioned at the bottom position, i.e. at 180°. The top position may also be referred to as the position closest to the gravitational field.

Figure 5:
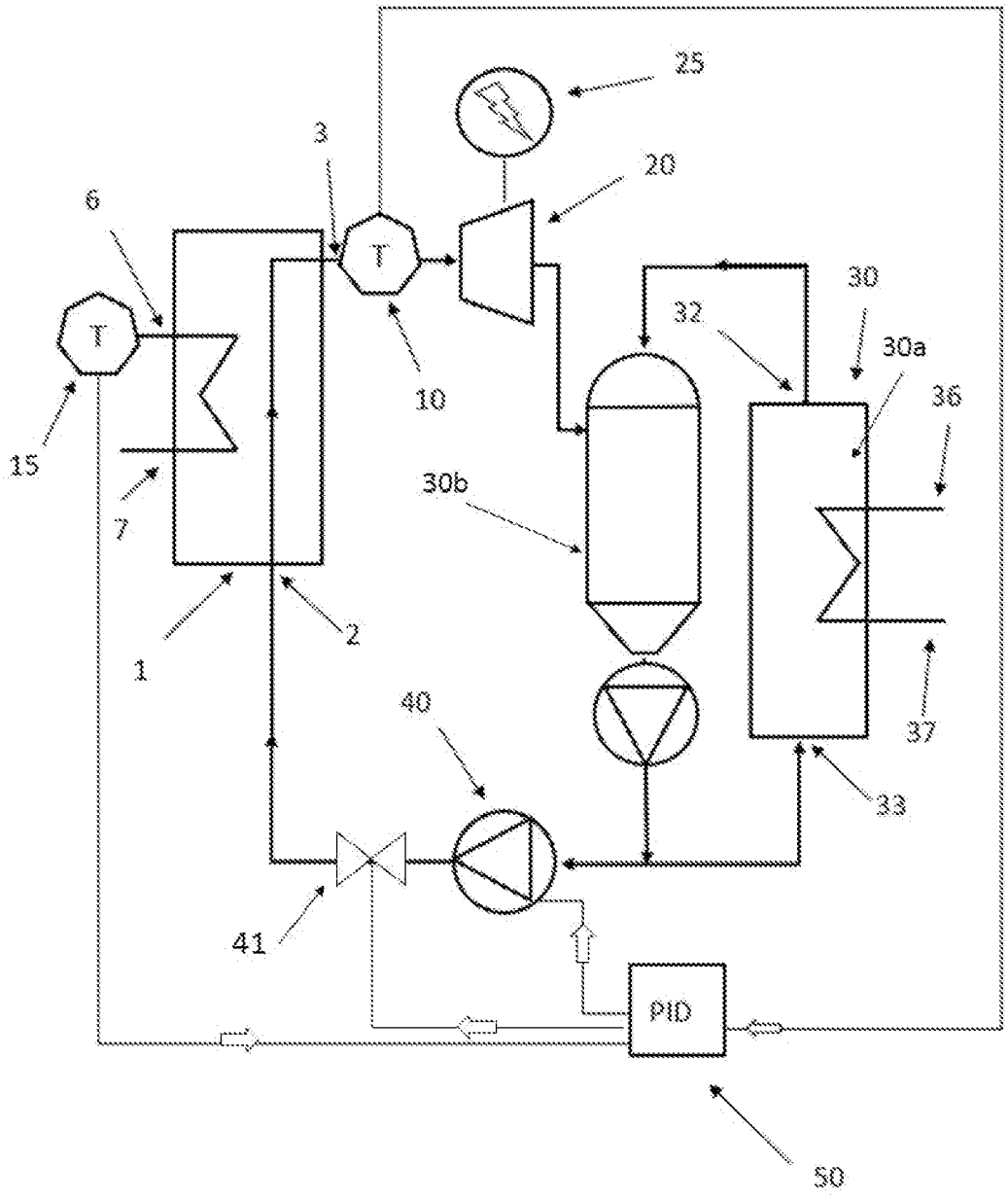
FIG. 5 illustrates a waste heat power generator in which the present invention may be utilized.

FIG. 5 illustrates a waste heat power generator in which the present invention may be utilized. The waste heat power generator comprises a circulating first medium, a heat exchanger (1) in which said first medium is arranged to be heated by a second medium and wherein said heat exchanger is configured to boil or evaporate said first medium generating a gas, a turbine (20) coupled to a power-generating device (25) configured to generate electric power while expanding the gas, a condenser arrangement (30) configured to condense the gas which has passed through the power-generating device, and a device (40, 41) for regulating flow of the condensed first medium into the heat exchanger (1). The condenser arrangement may comprise only a heat exchanger 30*a* to cool and condense the first medium or a heat exchanger arranged to cool the first medium and a separate condenser tank 30*b* to condense the first medium. The first temperature sensor array 10 as well as the second temperature sensor array 15 are also illustrated.

The system and method according to the present invention may be used in any heat exchanger. In preferred embodiments of the invention, the system and method are used with heat exchangers used in power plants. In further preferred embodiments, the system and method are used with heat exchanger used in power plants employing thermodynamic cycles such as the Rankine cycle, Kalina cycle, Carbon Carrier cycle and/or Carnot cycle are used. Example of power plants in which the present invention may be used (but not limited to) are described WO2012128715, WO2014042580, WO2015034418, WO2015112075, WO2015152796, WO2016076779 and PCT/SE2016/050996. In further preferred embodiments, the system and method are used with heat exchanger which are coupled to a turbine and/or compressor. Examples of systems comprising a turbine are described in (but not limited to) WO2015112075. Examples of systems comprising a compressor are described in (but not limited to) WO2015034418.

EXAMPLE 1

An embodiment of the invention as described in FIG. 5, relates to a system and a method for eliminating the presence of droplets in the outlet port (or alternatively before or after the outlet port) of the first medium in a plate heat exchanger 1 (i.e. plate-type heat exchanger) which is configured as a boiler. The plate heat exchanger 1 may be connected to either a turbine or a compressor 20.

The plate heat exchanger 1 has an inlet port 2, 6 and an outlet port 3, 7 for both the first medium and the second medium. The first medium comprises acetone and is heated by the second medium which comprises water. The device 40, 41 which regulates the flow of the first medium, i.e. acetone, into the plate heat exchanger is a pump. However, in alternative embodiments, said device may be a combination of (i) pump and valve, or (ii) pump and injector. A further alternative is that said device may be a combination of pump, valve and an injector.

The system and method further comprises a first temperature sensor array 10 which measures the temperature of the acetone exiting the heat exchanger. The second temperature sensor array 15 measures the temperature of water entering the heat exchanger. The first temperature sensor array comprises a first temperature sensor 10A and a first temperature sensor 10B wherein each sensor is a resistance temperature detector such as a platinum resistance thermometer. A platinum resistance thermometer having a nominal resistance of 10-1000 ohms at 0° C. may be used as a temperature sensor. In preferred embodiments of Example 1, the temperature sensor is a platinum resistance thermometer having a nominal resistance of 100 ohms at 0° C. In some embodiments of Example 1, the first temperature sensor array may only comprise a single temperature sensor.

The system and method further comprises a PID controller which is connected to the pump, the second temperature sensor array, the first temperature sensor A as well as the first temperature sensor B. The PID controller controls the pump (or alternatively pump, valve and/or injector if such devices are present in the heat exchanger) for regulating flow of acetone into the heat exchanger based on data received from the second temperature sensor array, the first temperature sensor A and the first temperature sensor B. In embodiments of Example 1 in which the systems and method comprise pump, valve and/or injector as said device, the PID controller is connected to each of pump, valve and/or injector. More importantly, the PID controller controls each of pump, valve and/or injector. In some embodiments of Example 1, the PID-controller is part of a PLC.

The first temperature sensor array 10 is arranged at a position at the outlet port 3 of the first medium (or alternatively before or after the outlet port). The first temperature sensor 10A and a first temperature sensor 10B may be positioned either (i) at an approximately equal distance from the outlet port of the first medium, or (ii) an unequal distance from the outlet port of the first medium. Moreover, the first temperature sensor A and a first temperature sensor B may be positioned at a circumferential position 0-360° at the outlet port of the first medium (or alternatively before or after said outlet port). In preferred embodiments, one of first temperature sensor 10A and a first temperature sensor 10B is positioned at a top position while the other is positioned at the bottom position. The second temperature sensor array 15 is arranged at the inlet port 6 of the second medium (or alternatively before or after said inlet port) and is positioned at a circumferential position 0-360° at the inlet port 6 of the second medium. Preferably the second temperature sensor array 15 is positioned (i) at a top position, and/or (ii) at the bottom position.

Some of the positions of the first temperature sensor array 10 in the outlet port 3 of the first medium are illustrated in FIG. 3. In FIG. 3*a*, the first temperature sensor array 10 only comprises one temperature sensor and is positioned at the top position, i.e. at 0°. The top position may also be referred to as the position furthest away from the gravitational field. In FIG. 3*b*, the first temperature sensor array comprises two temperature sensors being a first temperature sensor A 10A and a first temperature sensor B 10B and these sensors are placed opposite of each other at the top and bottom positions. FIG. 3*c* shows an outlet with a first temperature sensor array comprising two temperature sensors being a first temperature sensor A 10A and a first temperature sensor B 10B and wherein these sensors are placed at the bottom position. FIG. 3*d* also shows an outlet with a first temperature sensor array comprising two temperature sensors being a first temperature sensor A 10A and a first temperature sensor B 10B, however, the sensors are placed at the top position. In FIG. 3*e*, the first temperature sensor array only comprises one temperature sensor 10 and is positioned at the bottom position, i.e. at 180°. The bottom position may also be referred to as the position closest to the gravitational field. The second temperature array may be positioned in a similar manner at the inlet of the second medium. It should be noted that the top and bottom position are merely two of many positions which the temperature arrays and sensors thereof may be positioned, i.e. temperature arrays and sensors may be positioned at a circumferential position 0-360° at the inlet and outlet ports.

The PID controller 50 reduces the flow of the first medium into the plate heat exchanger if the measured temperature difference between the second temperature sensor array 15 and either one of first temperature sensor 10A and a first temperature sensor 10B is higher than a setpoint temperature of 2° C. The flow of acetone into the plate heat exchanger 1 is reduced until the measured temperature difference between the second temperature sensor array and either one of the first temperature sensor 10A and the first temperature sensor 10B is lower than or equal to a setpoint temperature of 2° C.

In further embodiments of Example 1, acetone and water are replaced as first medium and second medium, respectively, with other solvents such as water, alcohols (such as methanol, ethanol, butanol and/or isopropanol), ketones (such as acetone and/or methyl ethyl ketone), amines, paraffins (such as pentane and hexane) and/or ammonia. When the first medium and/or second medium are replaced with one or more solvents, a new setpoint temperature is may be determined. However, in most cases the set point temperature remains the same. The new setpoint temperature may be within the interval of 1-10° C.

In preferred embodiments, the system and method of Example 1 is used in a gasketed plate heat exchangers which consists of many corrugated stainless-steel sheets separated by polymer gaskets and clamped in a steel frame. Inlet portals and slots in the gaskets direct the hot and cold fluid to alternate spaces between plates. The corrugation induce turbulence for improved heat transfer, and each plate is supported by multiple contacts with adjoining plates, which have a different pattern or angle of corrugation. The space between plates is equal to the depth of the corrugations. With liquid solutions on both sides, i.e. liquid solutions as first and second medium, the overall coefficient for a plate-type exchanger is several times the normal value for a shell-and-tube exchanger. Moreover, a plate-type exchanger is easily cleaned and sanitized.

EXAMPLE 2

The embodiments of Example 2 differ from the embodiments of Example 1 in that the system and method is applied in a heat exchanger which is a plate-and-shell heat exchanger which combines plate heat exchanger with shell and tube heat exchanger technologies.

EXAMPLE 3

The embodiments of Example 3 differ from the embodiments of Example 1 in that the system and method is applied in a heat exchanger which is a plate-fin heat exchanger, i.e. a heat exchanger which comprises plates and finned chambers to transfer heat between the first medium and the second medium. A plate-fin heat exchanger is made of layers of corrugated sheets separated by flat metal plates to create a series of finned chambers. Separate hot and cold fluid (i.e. second and first media) streams flow through alternating layers of the heat exchanger and are enclosed at the edges by side bars. Heat is transferred from one stream through the fin interface to the separator plate and through the next set of fins into the adjacent fluid/medium. The fins also serve to increase the structural integrity of the heat exchanger and allow it to withstand high pressures while providing an extended surface area for heat transfer.

EXAMPLE 4

The embodiments of Example 4 differ from the embodiments of Example 1 in that the system and method is applied in a heat exchanger which is a shell-and-tube heat exchanger. A shell-and-tube heat exchanger comprises a shell (i.e. a large pressure vessel) with a bundle of tubes (i.e. pipes) inside it. One fluid (e.g. first medium) runs through the tubes, and another fluid (e.g. the second medium) flows over the tubes (through the shell) to transfer heat between the two fluids (i.e. between the first medium and the second medium). The set of tubes is called a tube bundle, and may be composed of several types of tubes: plain, longitudinally finned. The preferred shell-and-tube heat exchanger may be selected from single-pas 1-1-exchanger, multipass exchanger (such as a 1-2 exchanger), 1-2 exchanger, 2-4 exchanger, cross-flow exchanger, or variants thereof.

EXAMPLE 5

The embodiments of Example 5 relate to the systems and methods described in Examples 1-4 which are applied in a waste heat power generator such as the one illustrated in FIG. 5.

The waste heat power generator is a closed loop thermodynamic system, preferably an ORC system, comprises a circulating working medium, i.e. first medium, circulating through a turbine 20 coupled to a power-generating device 25 which is configured to generate electric power while expanding the gas which is produced in a first heat exchanger 1 by boiling and overheating the working medium by guiding a hot heat transferring second medium through the first heat exchanger. The gas which has passed through the turbine 20 and power-generating device 25 is condensed in a condensation arrangement 30 by cooling the gas with a cooling medium. The condenser arrangement 30 comprise a second heat exchanger 30*a* arranged to cool a stream of working medium and a separate condenser tank 30*b* to condense the working medium. The second heat exchanger 30*a* has an inlet 36 and an outlet 37 for the cooling medium as well as an inlet 33 and an outlet 32 for the working medium, i.e. an inlet 32 for the gas entering the condenser and an outlet 33 for the condensate.

A pump 40 conveys the working medium condensed at the condenser to the first heat exchanger 1. The working medium (i.e. the first medium) enters the first heat exchanger 1 via the inlet port 2 of the first medium and exits through the outlet port 3 of the first medium in the form of gas. The second medium enters the first heat exchanger via the inlet port 6 of the second medium and then exits via the outlet port 7 of the second medium.

The first temperature sensor array 10 is arranged at a position at the outlet port of the first medium 3 or alternatively before or after said outlet port. The second temperature sensor array 15 is arranged at the inlet port of the second medium 6 or alternatively before or after said inlet port. The first and second temperature sensor arrays may each comprise one or more temperature sensors.

The number of degrees Celsius which the working medium gas is overheated is defined as an overheating temperature, $\Delta T_{overheat}$, and this may be set, for example depending on turbine type and turbine characteristics.

EXAMPLE 6

The embodiments of Example 6 differ from the embodiments in Examples 1-5 in that there is no measurement of the temperature difference between the second temperature sensor array and the first temperature sensor array.

Instead, in the embodiments of Example 6, if the temperature sensor/sensors of the first temperature sensor array are indicating a lower temperature than expected, the controller regulates the first medium flow (i.e. working media flow) into the heat exchanger. Consequently, the embodiments of Example 6 optimize the heat exchanger to boil as much of the first medium as possible without getting droplets out of the heat exchanger port (i.e. outlet port of the first medium).

Furthermore, in further embodiments of Example 6, to optimize the boiling in the heat exchanger, the incoming liquid medium (i.e. second medium) to the heat exchanger may further be controlled by using the calculated boiling point for the working medium (i.e. first medium) at the gas outlet (i.e. outlet port of the first medium) pressure. This boiling point temperature is compared with heating liquid (i.e. second medium) temperature coming out of the heat exchanger. Using this differential value in a controller one can further optimize the boiling in the heat exchanger.

What is claimed is:

1. A system for eliminating a presence of droplets in a first medium arranged to be heated by a second medium in a heat exchanger, wherein the heat exchanger has an inlet port and an outlet port for the first medium, and an inlet port and an outlet port for the second medium, wherein the second medium transfers heat to the first medium, the system comprising:

a first temperature sensor array configured for measuring a temperature of the first medium exiting the heat exchanger, the first temperature sensor array comprising at least one temperature sensor;

a controller connected at least to a device for regulating flow of the first medium into the heat exchanger and the first temperature sensor array; and a second temperature sensor array connected to the controller and configured for measuring a temperature of the second medium entering the heat exchanger, the second temperature sensor array comprising at least one temperature sensor, wherein the controller is configured to control the device for regulating flow of the first medium into the heat exchanger based on data received from the first temperature sensor array and the second temperature sensor array, wherein the controller is configured to control the device for regulating flow of the first medium to reduce the flow of the first medium into the heat exchanger if a measured temperature difference between the second temperature sensor array and the first temperature sensor array is higher than a setpoint temperature ($T_{set}$), wherein the temperature difference being higher than the setpoint temperature is indicative of the presence of droplets passing the outlet port of the first medium, and wherein the controller is configured to control the device for regulating flow of the first medium to reduce the flow of the first medium into the heat exchanger until the measured temperature difference between the second temperature sensor array and the first temperature sensor array is lower than or equal to the setpoint temperature ($T_{set}$).

2. The system according to claim 1, wherein the first temperature sensor array comprises at least two temperature sensors being a first temperature sensor A and a first temperature sensor B, wherein the controller is configured to control the device for regulating flow of the first medium to reduce the flow of the first medium into the heat exchanger if the measured temperature difference between the second temperature sensor array and either one of the first temperature sensor A and the first temperature sensor B is higher than the setpoint temperature ($T_{set}$), and wherein the controller is configured to control the device for regulating flow of the first medium to reduce the flow of the first medium into the heat exchanger until the measured temperature difference between the second temperature sensor array and either one of the first temperature sensor A and the first temperature sensor B is lower than or equal to the setpoint temperature ($T_{set}$).

3. The system according to claim 1, wherein the first medium is arranged to be boiled or evaporated and overheated to a selected overheating temperature ($\Delta T_{overheat}$) by the second medium in the heat exchanger.

4. The system according to claim 1, wherein the first temperature sensor array is arranged in the heat exchanger outlet port of the first medium at a position (i) before the heat exchanger outlet port of the first medium, (ii) at the heat exchanger outlet port of the first medium, and/or (iii) after the heat exchanger outlet port of the first medium, and wherein the first temperature sensor array is arranged in a tube leading the first medium away from the heat exchanger.

5. The system according to claim 2, wherein the first temperature sensor A and the first temperature sensor B are positioned: (i) at an approximately equal distance from the heat exchanger outlet port of the first medium, or (ii) an unequal distance from the heat exchanger outlet port of the first medium.

6. The system according to claim 2, wherein the first temperature sensor A and the first temperature sensor B are positioned at a circumferential position 0-360° (i) before the heat exchanger outlet port of the first medium, (ii) at the heat exchanger outlet port of the first medium, and/or (iii) after the heat exchanger outlet port of the first medium, and wherein the first temperature sensor A and the first temperature sensor B are positioned (i) at a top position, (ii) at a bottom position, (iii) at an angle of +/−45° within the circumferential position and/or (iv) anywhere within the outlet port of the first medium.

7. The system according to claim 1, wherein the setpoint temperature ($T_{set}$) depends on process conditions in the system, and wherein the process conditions are at least one of the following: type of medium used as first medium, type of medium used as second medium, pressure(s) and flows in the system, ambient temperature, selected overheating temperature ($\Delta T_{overheat}$), differential temperature of the second medium between inlet port and outlet port of the heat exchanger.

8. The system according to claim 1, wherein the setpoint temperature is between 10° C. and 2° C.

9. The system according to claim 1, wherein the controller is a Proportional Integral Derivative (PID) controller or a PID controller in a Programmable Logic Controller (PLC).

10. The system according to claim 1, wherein the at least one of the temperature sensors of the first and second temperature sensor arrays is a resistance temperature detector, wherein at least one of the temperature sensors of the first and second temperature sensor arrays is a platinum resistance thermometer, and wherein at least one of the temperature sensors of the first and second temperature sensor arrays is a platinum resistance thermometer having a nominal resistance of 10-1000 ohms at 0° C.

11. The system according to claim 1, wherein the at least one of the temperature sensors of the first and second temperature sensor arrays is at least two temperature measuring wires, and wherein the at least two temperature measuring wires are either configured in parallel, perpendicular or at any angle with respect to each other.

12. A method for eliminating a presence of droplets in a first medium arranged to be heated by a second medium in a heat exchanger, the method comprising:

guiding a second medium and a first medium through a heat exchanger to transfer heat from the second medium to the first medium, wherein the heat exchanger comprises:

an inlet port and an outlet port for the first medium, wherein the first medium is a medium to which heat is transferred, and an inlet port and an outlet port for the second medium which transfers heat to the first medium;

regulating a flow of the first medium into the heat exchanger, by using a device for regulating the flow;

measuring a temperature of the first medium exiting the heat exchanger, by using a first temperature sensor array, the first temperature sensor array comprising at least one temperature sensor;

measuring a temperature of the second medium entering the heat exchanger, by using a second temperature sensor array, the second temperature sensor array comprising at least one temperature sensor;

controlling the device for regulating flow of the first medium into the heat exchanger based on data received from the first temperature sensor array and second temperature sensor array, by using a controller connected at least to (i) the device for regulating the flow of the first medium into the heat exchanger, (ii) first temperature sensor array, and (iii) second temperature sensor array;

comparing data received from the first temperature sensor array and second temperature sensor array; and reducing the flow of the first medium into the heat exchanger if a measured temperature difference between the second temperature sensor array and the first temperature sensor array is higher than a setpoint temperature ($T_{set}$), wherein the temperature difference being higher than the setpoint temperature is indicative of the presence of droplets passing the heat exchanger outlet port of the first medium, and wherein the controller is configured to control the device for regulating the flow to reduce the flow of the first medium into the heat exchanger until the measured temperature difference between the second temperature sensor array and the first temperature sensor array is lower than or equal to the setpoint temperature ($T_{set}$).

13. The method according to claim 12, wherein the first temperature sensor array comprises two temperature sensors being a first temperature sensor A and a first temperature sensor B, wherein the controller is configured to control the device for regulating the flow to reduce the flow of the first medium into the heat exchanger if the measured temperature difference between the second temperature sensor array and either one of the first temperature sensor A and the first temperature sensor B is higher than the setpoint temperature ($T_{set}$), and wherein the controller is configured to control the device for regulating the flow to reduce the flow of the first medium into the heat exchanger until the measured temperature difference between the second temperature sensor array and either one of the first temperature sensor A and the first temperature sensor B is lower than or equal to the setpoint temperature ($T_{set}$).

14. The method according to claim 12, wherein the guiding of the first and second medium through the heat exchanger to transfer heat from the second medium to the first medium in the heat exchanger includes boiling or evaporating the first medium and overheating the first medium to a temperature above a theoretical boiling temperature by a heat transfer from the second medium.

15. The method according to claim 12, further comprising arranging the first temperature sensor array at a position (i) before the heat exchanger outlet port of the first medium, (ii) at the heat exchanger outlet port of the first medium, and/or (iii) after the heat exchanger outlet port of the first medium, and arranging the first temperature sensor array in a tube leading the first medium away from the heat exchanger.

16. The method according to claim 12, further comprising measuring the temperature of the first medium by at least a first temperature sensor A and a first temperature sensor B of the first temperature sensor array.

17. The method according to claim 16, further comprising arranging the first temperature sensor A and the first temperature sensor B: (i) at an approximately equal distance from the heat exchanger outlet port of the first medium, or (ii) an unequal distance from the heat exchanger outlet port of the first medium.

18. The method according to claim 16, further comprising arranging the first temperature sensor A and the first temperature sensor B at a circumferential position 0-360° (i) before the heat exchanger outlet port of the first medium, (ii) at the heat exchanger outlet port of the first medium, and/or (iii) after the heat exchanger outlet port of the first medium, wherein the first temperature sensor A and the first temperature sensor B are positioned (i) at a top position, (ii) at a bottom position (iii) at an angle of +/−45° within the circumferential position and/or (iv) at any angle within the circumferential position.

19. The method according to claim 12, further comprising setting a value of the setpoint temperature ($T_{set}$), wherein the value of the setpoint temperature ($T_{set}$) is set depending on process conditions in a system, and wherein the process conditions are at least one of the following: type of medium used as first medium, type of medium used as second medium, pressure(s) and flows in the system, ambient temperature, selected overheating temperature $\Delta T_{overheat}$, differential temperature of the second medium between inlet port and outlet port of the heat exchanger.

20. The method according to claim 19, wherein the value of the setpoint temperature set between 10° C. and 2° C.

21. A power plant including the system of claim 1, the power plant (i) implementing a thermodynamic cycle selected from the group consisting of Rankine cycle, Kalina cycle, Carbon Carrier cycle and Carnot cycle, and (ii) being a heat power generator comprising:

a circulating first medium;

a heat exchanger in which the first medium is arranged to be heated by a second medium and configured to boil or evaporate the first medium generating a gas;

a turbine coupled to a power-generating device configured to generate electric power while expanding the gas;

a condenser arrangement configured to condense the gas which has passed through the power-generating device; and a device for regulating flow of the condensed gas into the heat exchanger.

* * * * *